US010827274B2

(12) United States Patent
Yang et al.

(10) Patent No.: US 10,827,274 B2
(45) Date of Patent: Nov. 3, 2020

(54) DIAPHRAGM FOR PRODUCING SOUND AND SPEAKER USING SAME

(71) Applicant: AAC Technologies Pte. Ltd., Singapore (SG)

(72) Inventors: Binbin Yang, Shenzhen (CN); Bin Zhao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/435,587

(22) Filed: Jun. 10, 2019

(65) Prior Publication Data

US 2019/0379981 A1 Dec. 12, 2019

(30) Foreign Application Priority Data

Jun. 12, 2018 (CN) ..... 2018 2 0908724 U

(51) Int. Cl.

| | |
|---|---|
| ***H04R 25/00*** | (2006.01) |
| ***H04R 9/02*** | (2006.01) |
| ***H04R 7/04*** | (2006.01) |
| ***H04R 1/02*** | (2006.01) |

(52) U.S. Cl.
CPC ..... *H04R 9/025* (2013.01); *H04R 1/025* (2013.01); *H04R 7/04* (2013.01)

(58) Field of Classification Search
CPC ..... H04R 9/025; H04R 1/025; H04R 7/04
USPC ..... 381/412
See application file for complete search history.

(56) References Cited

U.S. PATENT DOCUMENTS

| | | | | |
|---|---|---|---|---|
| 6,111,969 | A * | 8/2000 | Babb | H04R 9/063 381/396 |
| 6,957,714 | B2 * | 10/2005 | Takahashi | H04R 7/20 181/171 |
| 7,054,459 | B2 * | 5/2006 | Kuze | H04R 7/20 181/172 |
| 7,397,927 | B2 * | 7/2008 | Pircaro | H04R 7/20 181/172 |
| 8,682,021 | B2 * | 3/2014 | Kosuda | H04R 7/06 381/398 |
| 9,173,037 | B2 * | 10/2015 | Watanabe | H04R 7/20 |
| 9,992,576 | B2 * | 6/2018 | Bae | H04R 9/043 |
| 2003/0112995 | A1 * | 6/2003 | Frasl | H04R 7/20 381/398 |
| 2006/0239494 | A1 * | 10/2006 | Kimura | H04R 7/127 381/386 |

(Continued)

*Primary Examiner* — Phylesha Dabney
(74) *Attorney, Agent, or Firm* — W&G Law Group LLP

(57) ABSTRACT

The present disclosure discloses a diaphragm for radiating sound, includes: a dome part and a suspension part surrounding the dome part. The suspension part includes a first subgroup, a second subgroup, and a third subgroup arranged in a sequence, the first subgroup being close to the dome part, the third subgroup away from the dome part, and the second subgroup between the first and third subgroups. Each of the first, second, and third subgroups includes a number of patterns arranged along a circumference direction of the dome part. Selected patterns in the second subgroup are opposite to corresponding patterns in the first subgroup, and selected patterns in the second subgroup are opposite to corresponding patterns in the third subgroup; and each corner of the suspension part is provided with the first subgroup, the second subgroup and the third subgroup.

8 Claims, 3 Drawing Sheets

(56) References Cited

U.S. PATENT DOCUMENTS

| | | | | |
|---|---|---|---|---|
| 2011/0194724 | A1* | 8/2011 | Watanabe | H04R 7/20<br>381/398 |
| 2016/0014519 | A1* | 1/2016 | Oclee-Brown | H04R 7/00<br>381/398 |
| 2016/0227324 | A1* | 8/2016 | Cai | H04R 7/14 |

* cited by examiner

DIAPHRAGM FOR PRODUCING SOUND AND SPEAKER USING SAME

FIELD OF THE PRESENT DISCLOSURE

The present disclosure relates to the field of electromagnetic transducers, more particularly to a speaker and a diaphragm used in the speaker.

DESCRIPTION OF RELATED ART

A speaker is a very important component equipped in a mobile phone for producing audible sounds. A speaker generally uses a diaphragm to produce vibration and further to generate sounds. The diaphragm is a key factor to determine the performance of the speaker. The diaphragm is generally provided with pleats for enhancing the strength of the diaphragm and further for solving problems caused by distortion of the diaphragm during vibration. In some cases, the pleats are arranged at corners of the diaphragm.

In a related speaker, a diaphragm includes a dome and a suspension surrounding the dome. The suspension includes a concave portion, and the pleats are arranged in the concave portion. However, the pleats in a concave portion will fold the diaphragm and the strength of the diaphragm is weakened, which will cause distortion and badly affect the performance of the speaker.

Therefore, an improved diaphragm and a speaker having such a diaphragm are desired.

SUMMARY OF THE PRESENT DISCLOSURE

One of the primary objects of the present disclosure is to provide a diaphragm with improved stiffness for avoiding distortion and ensuring the balance of vibration.

Accordingly, the present disclosure provides a diaphragm including: a dome part; a suspension part surrounding the dome part, including a first subgroup, a second subgroup, and a third subgroup arranged in a sequence, the first subgroup being close to the dome part, the third subgroup away from the dome part, and the second subgroup between the first and third subgroups; each of the first, second, and third subgroups including a plurality of patterns arranged along a circumference direction of the dome par. Selected patterns in the second subgroup are opposite to corresponding patterns in the first subgroup, and selected patterns in the second subgroup are opposite to corresponding patterns in the third subgroup; and each corner of the suspension part is provided with the first subgroup, the second subgroup and the third subgroup.

Further, selected patterns in the second subgroup extends into an interval formed by two adjacent patterns in the first subgroup.

Further, selected patterns in the second subgroup extends into an interval formed by two adjacent patterns in the third subgroup.

Further, the suspension part has a projecting part with a height greater than that of the dome part, and an edge part extending from an edge of the projecting part; the first, second and third subgroups are arranged on the projecting part.

Further, each of the patters protrudes from a surface of the projecting part along a direction away from the magnetic circuit system.

Further, the first subgroup, the second subgroup and the third subgroup radially extend toward a center of the diaphragm.

The present disclosure further provides a speaker incorporating the diaphragm mentioned above.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
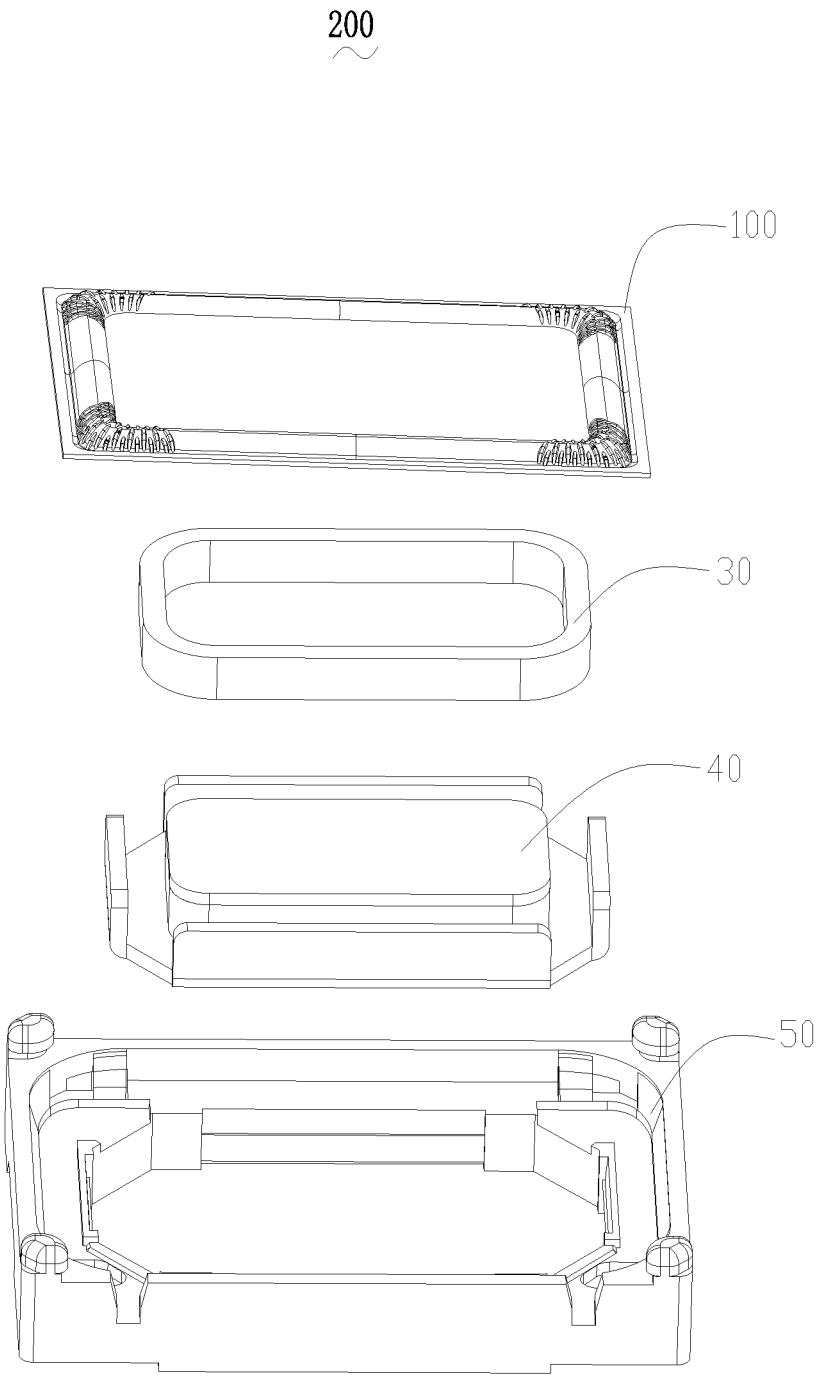
FIG. 1 is an illustrative isometric and exploded view of a speaker in accordance with an exemplary embodiment of the present disclosure.

Referring to FIG. 1, a speaker 200 in accordance with an exemplary embodiment of the present disclosure includes a vibration system, a magnetic circuit system 40 and a frame 50 accommodating the magnetic circuit system 40 and the vibration system. The vibration system includes a diaphragm 100 and a coil 30 for driving the diaphragm 100 to vibrate.

Figure 2:
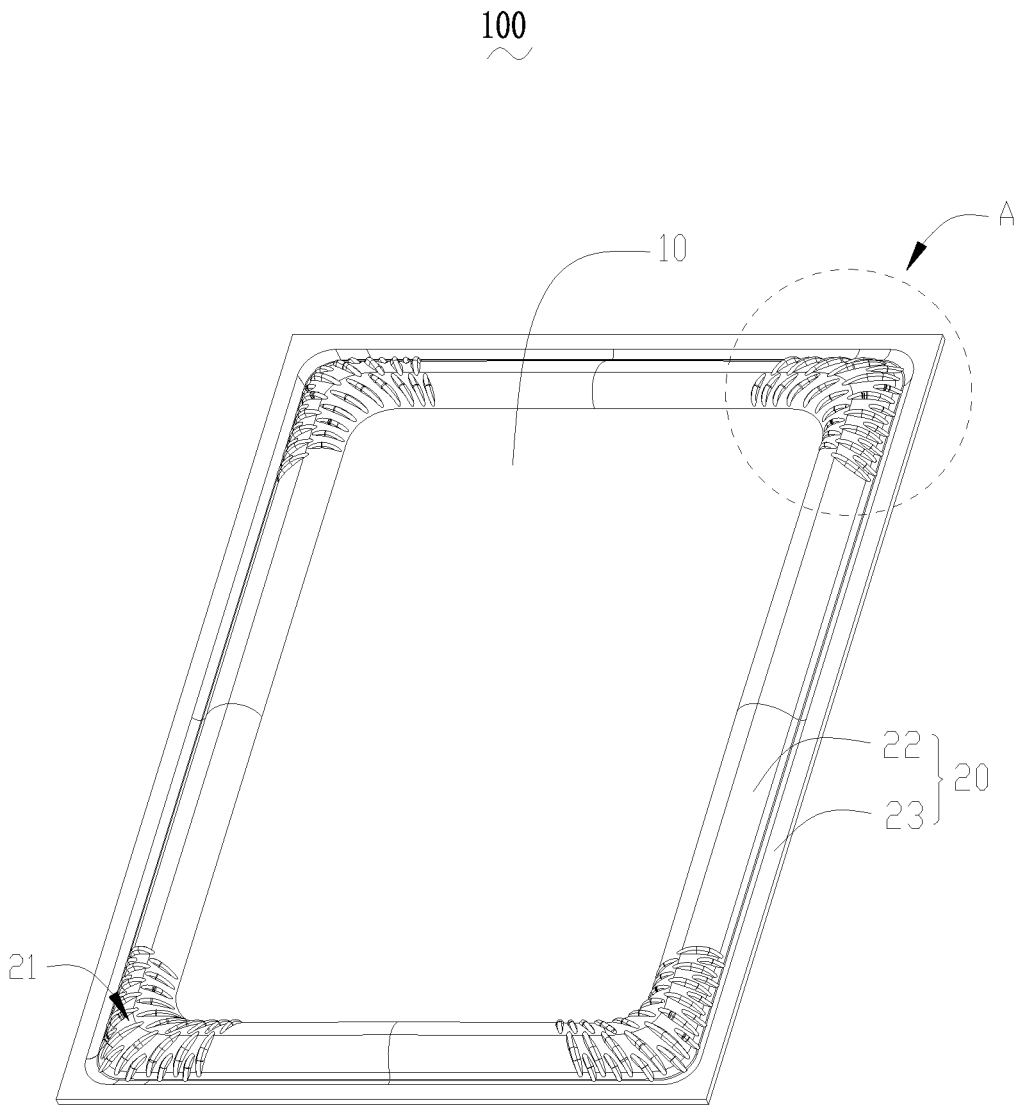
FIG. 2 is an isometric view of a diaphragm of the speaker in FIG. 1.
Figure 3:
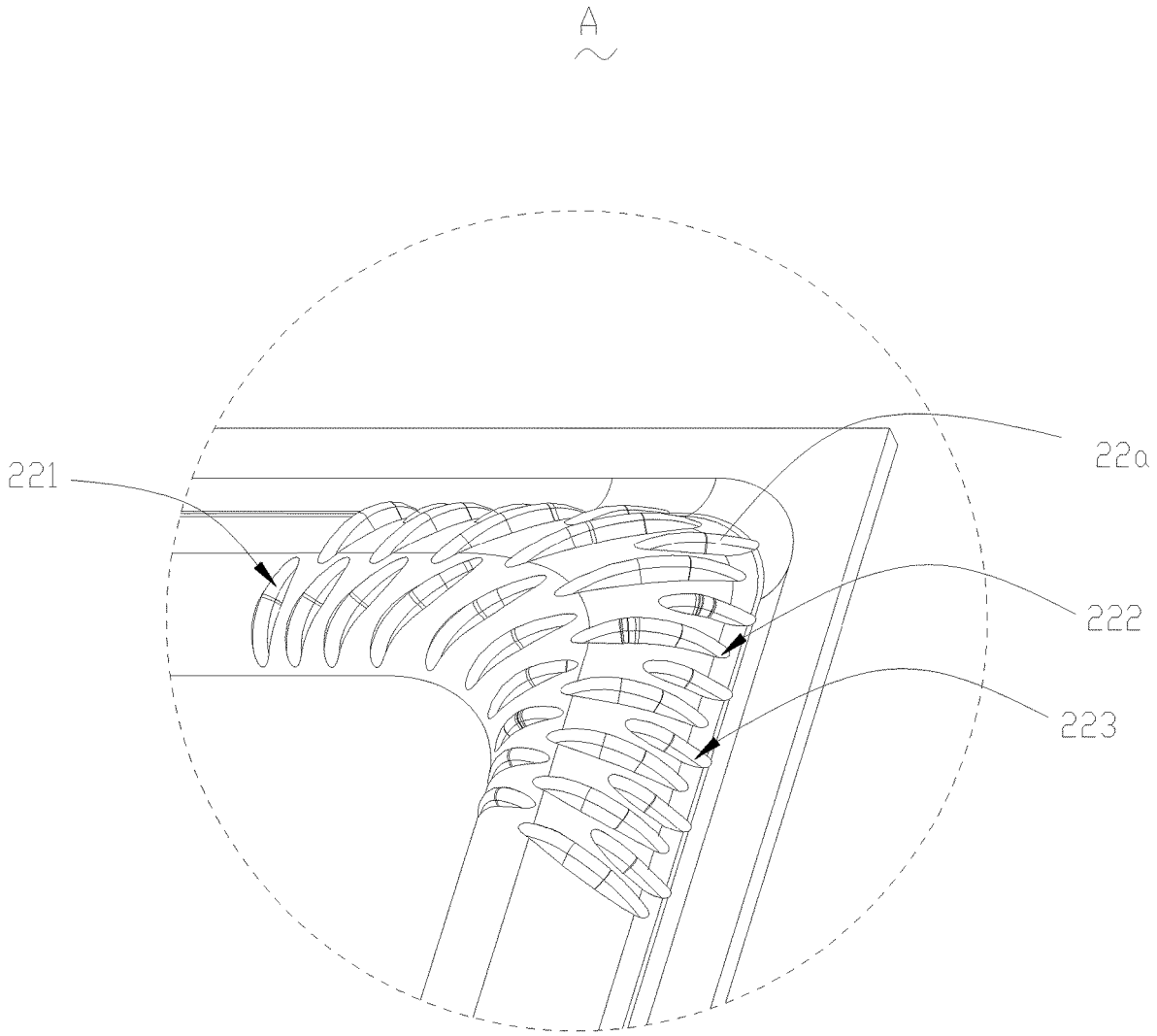
FIG. 3 is an enlarged view of Part A in FIG. 2.

Referring to FIGS. 2-3, the diaphragm 100 includes a dome part 10 and a suspension part 20. The suspension part 20 has a projecting part 22 with a height greater than that of the dome part 10, and an edge part 23 extending from an edge of the projecting part 22. In the embodiment, the diaphragm 100 is substantially a rectangle, the dome part 10 is planar, and the suspension part 22 is a ring surrounding the dome part 10. The projecting part 22 is an arc-shape projecting away from the magnetic circuit system 40. The suspension part 20 further includes four arc-shaped corners 21.

The projecting part 22 includes a plurality of patterns 22*a* for depressing unbalanced vibration and improving the acoustic performance of the speaker. Each of the pattern 22*a* protrudes from a surface of the projecting part 22 along a direction away from the magnetic circuit system. The patterns 22*a* also extends away from the dome part 10.

The arrangement of the patterns 22*a* can be adjusted according to actual needs. For balancing the vibration of the diaphragm, the patterns 22*a* can be divided into two groups symmetrical to each other. In the embodiment, the patterns 22*a* are arranged on arc-shaped corners. On each corner, the patterns 22*a* is divided into a first subgroup 221, a second subgroup 222, and a third subgroup 223. The subgroups 221, 222, 223 are arranged subsequently from the dome part 10 along a direction away from the dome part 10, which means the first subgroup 221 is close to the dome part 10, the third subgroup 223 keeps a distance from the dome part 10, and the second subgroup 222 locates between the first and third subgroups. Each of the subgroups includes a plurality of patterns 22*a* arranged along a circumference direction of the dome part 10. Patterns in the first subgroup are stagger from the patterns in the second subgroup, and the patterns in the second subgroup are stagger from those in the third subgroup.

As a whole, the first subgroup, the second subgroup and the third subgroup radially extend toward a center of the diaphragm. By virtue of this configuration, the strength of the diaphragm is improved, and the balance of the vibration of the diaphragm is ensured. Acoustic performance of the speaker is accordingly improved.

In the embodiment, the patterns in the second subgroup includes some opposite to the patterns in the first subgroup, and some opposite to the patterns in the third subgroup. In other words, some of the patterns in the second subgroup extend into the interval between two adjacent patterns in the first subgroup, and some of the patterns in the second subgroup extends into the interval between two adjacent patterns in the third subgroup.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A diaphragm for radiating sound, comprising:

a dome part;

a suspension part surrounding the dome part, including a first subgroup, a second subgroup, and a third subgroup arranged in a sequence, the first subgroup being close to the dome part, the third subgroup away from the dome part, and the second subgroup between the first and third subgroups;

each of the first, second, and third subgroups including a plurality of patterns arranged along a circumference direction of the dome part; wherein selected patterns in the second subgroup are opposite to corresponding patterns in the first subgroup, and selected patterns in the second subgroup are opposite to corresponding patterns in the third subgroup; and each corner of the suspension part is provided with the first subgroup, the second subgroup and the third subgroup;

selected patterns in the second subgroup extends into an interval formed by two adjacent patterns in the first subgroup.

2. The diaphragm as described in claim 1, wherein selected patterns in the second subgroup extends into an interval formed by two adjacent patterns in the third subgroup.

3. The diaphragm as described in claim 1, wherein the suspension part has a projecting part with a height greater than that of the dome part, and an edge part extending from an edge of the projecting part; the first, second and third subgroups are arranged on the projecting part.

4. The diaphragm as described in claim 3, wherein each of the patterns protrudes from a surface of the projecting part along a direction away from the magnetic circuit system.

5. The diaphragm as described in claim 4, wherein the first subgroup, the second subgroup and the third subgroup radially extend toward a center of the diaphragm.

6. A speaker, including:

a magnetic circuit system;

a vibration system;

a frame accommodating the magnetic circuit system and the vibration system;

wherein the vibration system includes a diaphragm as described in claim 1.

7. A speaker, including:

a magnetic circuit system;

a vibration system;

a frame accommodating the magnetic circuit system and the vibration system;

wherein the vibration system includes a diaphragm as described in claim 3.

8. The speaker as described in claim 7, wherein the projection part protrudes along a direction away from the magnetic circuit system.

* * * * *